US005394964A

United States Patent [19]

White

[11] Patent Number: 5,394,964

[45] Date of Patent: Mar. 7, 1995

[54] BRIEFCASE

[76] Inventor: Kenneth E. White, 1713 Edgebrooke La., Long Grove, Ill. 60047

[21] Appl. No.: 176,198

[22] Filed: Jan. 3, 1994

Related U.S. Application Data

[63] Continuation of Ser. No. 77,240, Jun. 14, 1993, abandoned.

[51] Int. Cl.[6] ..... A45C 9/00

[52] U.S. Cl. ..... 190/1; 190/109; 206/287.1

[58] Field of Search ..... 190/1, 109, 112; 206/287, 287.1

[56] References Cited

U.S. PATENT DOCUMENTS

| | | | |
|---|---|---|---|
| 1,983,036 | 12/1934 | Kaufman | 190/109 |
| 2,316,328 | 4/1943 | Guenther et al. | 190/109 X |
| 2,493,182 | 1/1950 | Beder | 190/109 |
| 2,554,215 | 5/1951 | Schell et al. | 190/109 X |
| 2,555,820 | 6/1951 | Satz | 190/109 X |
| 2,560,297 | 7/1951 | Lifton | 190/109 |
| 4,613,039 | 9/1986 | Shaw et al. | 206/287.1 |
| 4,655,343 | 4/1987 | Lane et al. | 206/287.1 |
| 4,693,368 | 9/1987 | King et al. | 206/287.1 |
| 4,887,700 | 12/1989 | Rice | 206/287.1 X |
| 4,976,340 | 12/1990 | Bieder et al. | 190/109 |
| 4,998,603 | 3/1991 | Nordstrom | 206/287.1 X |
| 5,060,795 | 10/1991 | Bomes et al. | 206/287.1 X |
| 5,113,982 | 5/1992 | Pulichino et al. | 206/287.1 X |

*Primary Examiner*—Allan N. Shoap
*Assistant Examiner*—Christopher McDonald
*Attorney, Agent, or Firm*—Douglas B. White

[57] ABSTRACT

Generally there is provided herein a briefcase design which is adapted to hang from a wall bracket and to open to expose pockets, compartments and an expandable file. The briefcase presents a middle pocket/compartment section, a top cover portion attached to this section to form the closure for the briefcase, and an invertible expandable file attached to the lower edge of the pocket/compartment section.

5 Claims, 4 Drawing Sheets

BRIEFCASE

This is a continuation of U.S. patent application Ser. No. 08/077,240, filed Jun. 14, 1993, now abandoned.

BACKGROUND OF THE INVENTION

1. Field of the Invention

This invention relates generally to briefcases and more particularly to such cases designed to provide a portable office function.

2. Description of the Prior Art

Prior briefcase designs which provide portable office functions have typically presented a portable desktop with drawers or shelves. These designs are exemplified by U.S. Pat. Nos. 5,078,460, 4,856,627, and 4,515,493. However, no design to date has been effective to fully expose the inner compartments and to provide convenient access to an expansion file when hung from a suitable support.

SUMMARY OF THE INVENTION

Generally there is provided herein a briefcase design which is adapted to hang from a wall bracket, whereupon it may be opened to expose pockets, compartments and an expandable file. The briefcase presents a middle compartment section, a top cover portion hingedly attached to this middle section and an invertible expandable file hingedly attached to the lower edge of the middle section.

While the invention will be described in connection with a preferred embodiment, it will be understood that it is not the intent to limit the invention to that embodiment. On the contrary, it is the intent to cover all alternatives, modifications, and equivalents as may be included within the spirit and scope of the invention as defined by the appended claims.

DESCRIPTION OF THE PREFERRED EMBODIMENT

Figure 1:
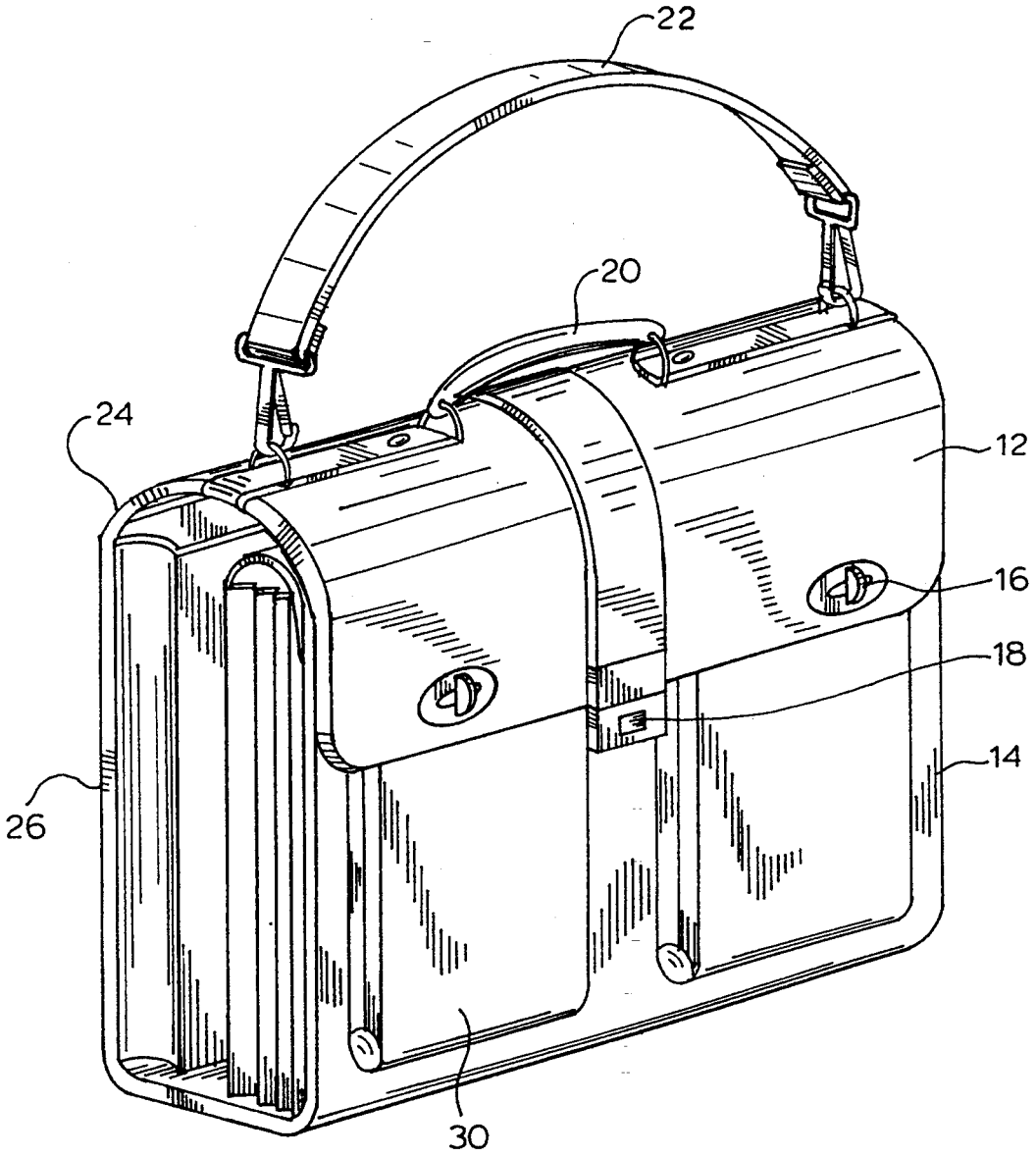
FIG. 1 is a perspective view of the briefcase of the present invention in a closed position.
Figure 2:
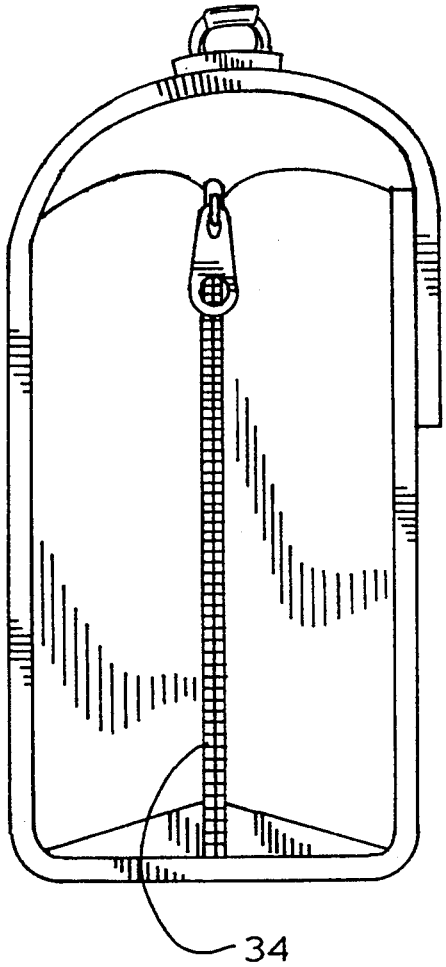
FIG. 2 is a side view of an alternative embodiment showing a side closure.

Turning first to FIG. 1 there is shown the briefcase design of the present invention having pockets, compartments and an expandable file for carrying supplies and files, and for providing a portable work station. A flexible top cover section 12 folds over the top of the briefcase to fasten to the front 14 thereof via fastening means 16 and 18. Additionally, a handle 20 and strap 22 attach to the top cover, forward of the edge hinge 24, where the top cover hingedly attaches to the back 26 of the briefcase. The front of the briefcase presents one or more pockets or compartments 30, and the side may alternatively be closed (FIG. 2) with zipper means 34 or the like.

Figure 3:
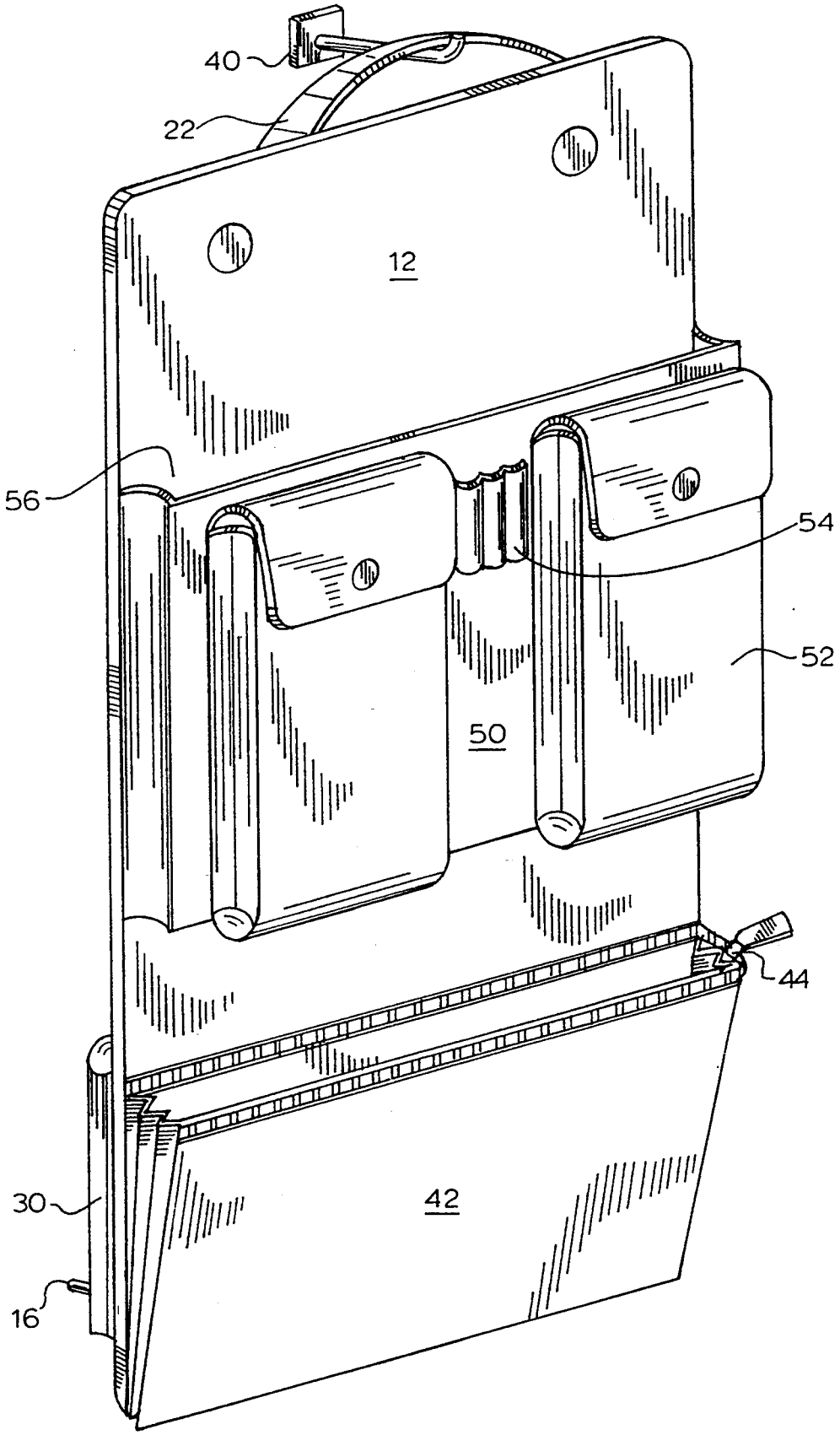
FIG. 3 is a perspective view of the briefcase of FIG. 1 in its open position.

As shown in FIG. 3, the briefcase is designed to be suspended from a support 40 by its strap 22. This suspension uses the weight of the briefcase to pull the top cover section 12 to its open position and allows the expandable file section 42 to drop into its upright position for access. (To further secure the expandable file, when inverted, a zippered closure 44 is provided.)

A middle pocket and compartment section 50 is exposed when the briefcase is opened as shown in FIG. 3. While many variations are possible, in the preferred embodiment pockets 52 and a pen/pencil holder 54 are positioned on the wall of a larger pocket 56. Consequently, when access to the briefcase, and particularly to the expandable file, is desired, the briefcase is easily suspended from any convenient support by the strap (or by the handle) and opened to expose the inner pockets and expandable file.

Figure 4:
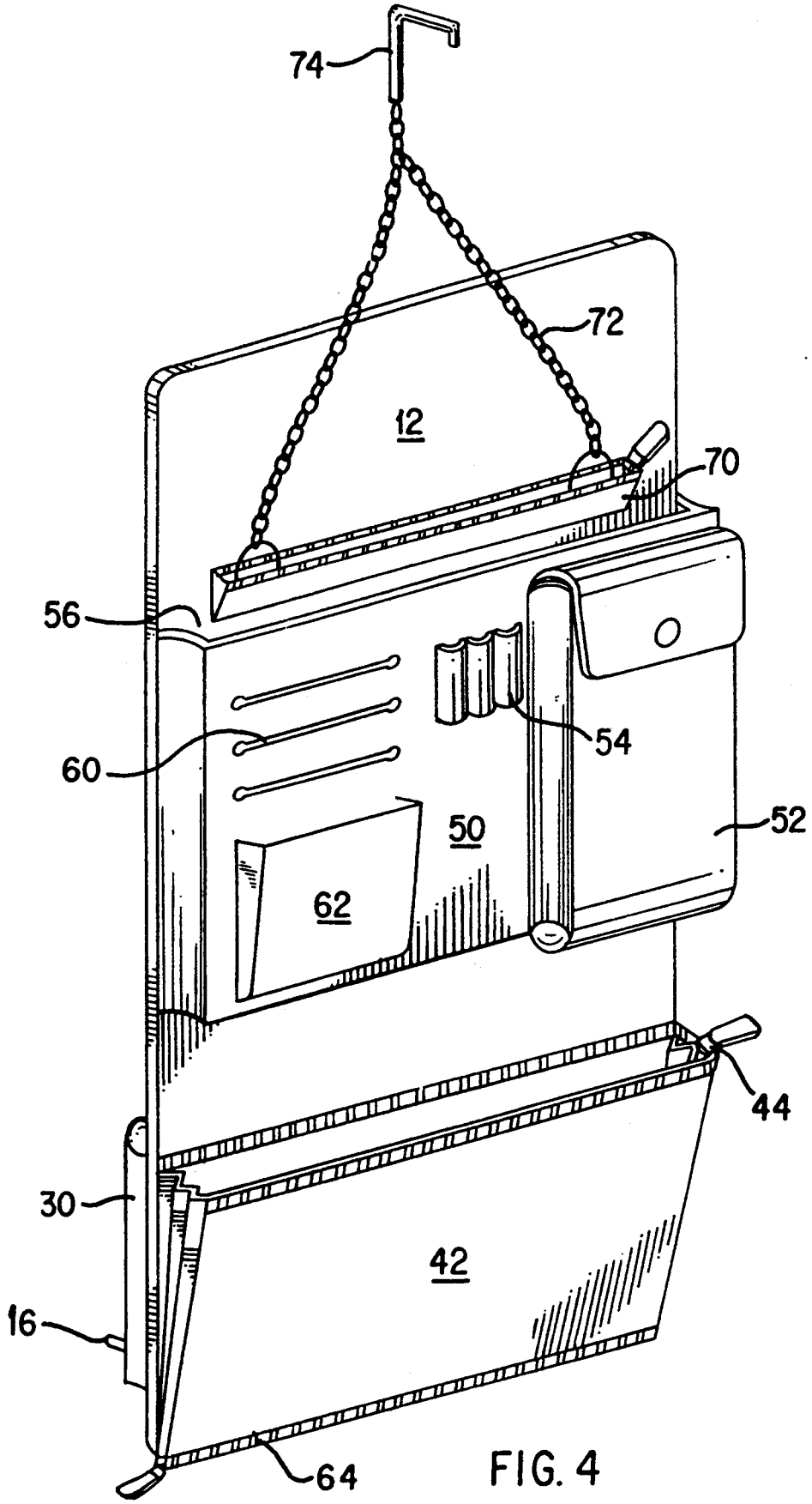
FIG. 4 is a perspective view of an alternative embodiment of the briefcase.

In an alternative embodiment, shown in FIG. 4, the middle section presents slits 60 to accept cards, and a pocket 62 to hold a calculator. The expandable file section 42 presents an additional zippered opening 64 to allow access to the file from either end. (This allows access to the file when the briefcase is hanging as shown in FIG. 4, as well as when it is folded, as shown in FIG. 1.) Suspension of this embodiment is accomplished by use of a chain 72 and hook 74, both of which are contained within the zippered pocket 70 when not in use.

From the foregoing description, it will be apparent that modifications can be made to the apparatus and method for using same without departing from the teachings of the present invention. Accordingly, the scope of the invention is only to be limited as necessitated by the accompanying claims.

I claim:

1. A briefcase for carrying supplies and files and for providing a portable work station when hung from a support comprising:

a middle compartment section having an upper edge and a lower edge;

an invertible expandable file section, having an upper edge and a lower edge and with access to said file section along said upper edge and said lower edge of said file section, said file section being hingedly attached along its upper edge to said lower edge of said middle compartment section and arranged to invert when folded along said hinged attachment against said middle compartment section;

closure means along said upper edge and said lower edge of said expandable file for closing said access to said expandable file; and a top closure attached along said upper edge of said middle compartment section and having means for fastening said top closure to said inverted expandable file section.

2. The briefcase of claim 1 further comprising closure means for closing the sides of said briefcase formed when said invertible expandable file section is folded against said middle compartment section,

3. The briefcase of claim 2 wherein said closure means comprises a zipper device,

4. The briefcase of claim 1 further comprising chain means and hook means attached within a pocket positioned on the inside of the briefcase for suspending said briefcase from the support,

5. The briefcase of claim 2 further comprising chain means and hook means attached within a pocket positioned on the inside of the briefcase for suspending said briefcase from the support,

* * * * *